US005503282A

United States Patent [19]

Montgomery

[11] Patent Number: 5,503,282

[45] Date of Patent: Apr. 2, 1996

[54] CLOSURE FOR PRESSURIZED CONTAINER

[75] Inventor: Gary V. Montgomery, Evansville, Ind.

[73] Assignee: Sunbeam Plastics Corporation, Evansville, Ind.

[21] Appl. No.: 419,043

[22] Filed: Apr. 10, 1995

[51] Int. Cl.[6] ..... B65D 41/34

[52] U.S. Cl. ..... 215/252; 215/343; 215/345

[58] Field of Search ..... 215/343, 345, 215/252

[56] References Cited

U.S. PATENT DOCUMENTS

| | | | |
|---|---|---|---|
| 3,425,579 | 2/1969 | Braun et al. | 215/345 X |
| 3,599,821 | 8/1971 | Eggert | 215/345 X |
| 3,608,764 | 9/1971 | Hedgewick . | |
| 4,238,042 | 12/1980 | Hatakeyama et al. | 215/343 X |
| 4,320,844 | 3/1982 | Cooper . | |
| 4,531,649 | 7/1985 | Shull . | |
| 4,564,117 | 1/1986 | Herbert . | |
| 4,640,428 | 2/1987 | Chang . | |
| 5,103,991 | 4/1992 | Collins | 215/252 X |
| 5,320,233 | 6/1994 | Welch | 215/252 |

FOREIGN PATENT DOCUMENTS

| | | | |
|---|---|---|---|
| 552086 | 7/1993 | European Pat. Off. . | |
| 1081334 | 12/1954 | France . | |
| 4007325 | 9/1991 | Germany | 215/345 |
| 324467 | 1/1930 | United Kingdom . | |
| 383102 | 11/1932 | United Kingdom . | |

*Primary Examiner*—Allan N. Shoap
*Assistant Examiner*—Stephen Cronin
*Attorney, Agent, or Firm*—Gifford, Krass, Groh, Sprinkle, Patmore, Anderson & Citkowski

[57] ABSTRACT

A two piece closure is shown for use with a pressurized container such as a carbonated soft drink bottle. A threaded cap has a gas barrier sealing insert snap attached to it for sealing the insert to the cap and to the lip of the container neck in pressure enhanced relationship.

5 Claims, 1 Drawing Sheet

Fig-1
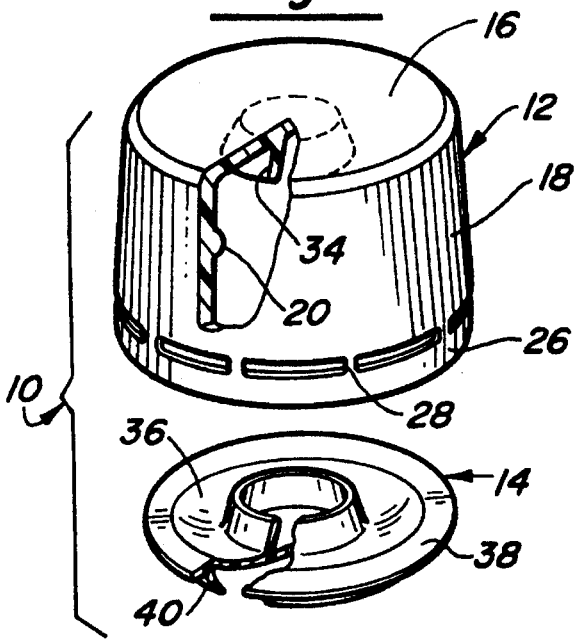
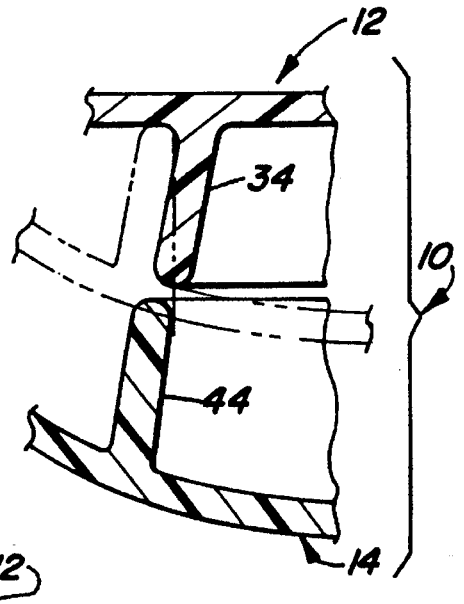
Fig-3
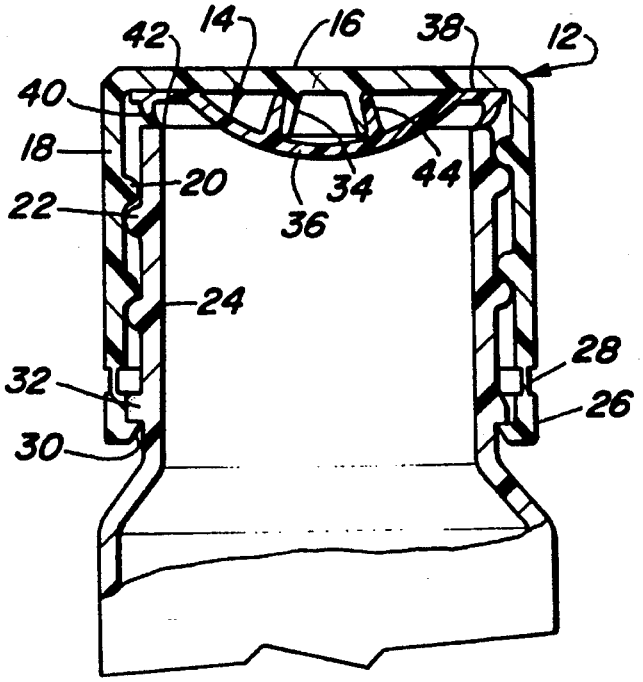
Fig-2

CLOSURE FOR PRESSURIZED CONTAINER

BACKGROUND OF THE INVENTION

1. Field of the Invention

This invention relates to a closure for attachment to the neck of a liquid containing container. More particularly, this invention relates to a two piece pressure enhanced barrier closure for a pressurized liquid container.

2. Problems Encountered in the Art

There is an increased demand for plastic closures for pressurized containers such as carbonated soft drink bottles. A design evolution has taken place in recent years to overcome various problems associated with molded plastic closure such as the undesirable gas permeability of plastics and the tendency of plastics to creep under continuing pressure conditions presenting the possibility of liquid or gas leakage.

SUMMARY OF THE INVENTION

The present invention overcomes difficulties experienced in the past including those associated with material creep and gas permeability. This is accomplished in a two piece closure which provides a gas barrier and a pressure enhanced seal as well as a unique structural integrity. The closure includes a conventional threaded cap having a top and an internally threaded annular skirt depending from the periphery of the top. A liner, made from a material providing a gas barrier, has a strength enhancing concave central portion, a contiguous cap sealing annular portion for contacting the inner surface of the cap top and an inwardly directed annular sealing fin portion which contacts the container neck lip so that an increase in container pressure increases the force that the sealing fin exerts on the container neck lip. Snap retention of the liner to the cap top allows relative rotation between the liner and the cap so that the liner can remain in stationary sealing contact with the container neck as the cap is threaded onto the neck. The liner can be made with PET, that is polyethylene terephthalate, which has good gas barrier properties and is the material with which the container is normally bow molded. A tamper indicating band is optionally connected to the bottom of the cap skirt by integrally molded frangible webs so that the webs are fractured leaving the band on the container neck when the cap is initially unthreaded from the container neck.

BRIEF DESCRIPTION OF THE DRAWING

The advantages of the present invention will be more apparent from the following detailed description when considered in connection with the accompanying drawing wherein:

FIG. 1 is an exploded perspective view showing how the two piece closure structure is assembled;

FIG. 2 is a sectional elevational view of the assembled closure as it has been applied to a container neck; and FIG. 3 is an enlarged partial sectional view showing a portion of the cap interior and the insert as they are assembled to one another.

DESCRIPTION OF THE PREFERRED EMBODIMENT

The closure of this invention is shown as including a threaded cap 12 and a liner or insert 14. The threaded cap 12 has a planar top 16 and an annular skirt 18 depending from the periphery of the top with an internal thread 20 for engaging the external thread 22 on a container neck 24. The cap 12 optionally carries a tamper indicating band 26 which depends from the bottom of the cap skirt 18 by a series of circumferentially spaced axially extending frangible webs 28. The tamper indicating band has an inwardly directed bead 30 which engages underneath a container neck flange 32 when the closure is fully threaded onto the container neck. When the closure 10 is initially opened by unthreading the cap 12, the tamper indicating band 26 is retained on the container neck by the coaction of the band bead 30 with the container neck flange 32 causing fracture of the frangible webs 28 indicating tampering or initia opening of the closure. The cap top has a tubular projection 34 formed as an inner skirt member extending downwardly from the inside of the cap top 16 diverging outwardly.

The insert or liner 14 is made with a gas barrier plastic such as PET, polyethylene terephthalate, and includes a central concave portion 36, a contiguous annular cap sealing portion 38 which contacts and seals against the inner surface of the cap top 16, and an inwardly directed annular sealing fin portion 40 for contacting the container lip 42. The insert 14 also has an upwardly directed socket 44 formed by an inner skirt converging upwardly from the central portion 36 of the insert for snap retention of the cap projection 34. FIG. 3 shows how the tubular projection on the cap top and the tubular socket wall 44 on the insert yields as the two members are snapped together. This allows relative rotation between the cap 12 and the insert 14 so that the insert 14 can remain stationary with the sealing fin 40 contacting the container neck lip 42 as the cap 12 is threaded onto the container neck 24.

It will be obvious that many modifications can be made to the two components of the closure without departing from the invention taught and claimed. For example, the insert 14 could be retained in the cap 12 by an inwardly directed bead located on the cap skirt 18 between the top of thread 20 and the cap top 16 which would snap retain the outer periphery of the insert sealing surface 38.

I claim:

1. A threaded two piece, pressure enhanced barrier closure for application to a threaded container neck, comprising:

a cap having a planar top and an annular skirt depending from the periphery of said top, said skirt having internal container neck engaging threads;

an insert having a continuously curved downwardly concave central portion, a contiguous annular portion for contacting an inner surface of said cap top, and an annular sealing fin portion projecting downwardly and radially inwardly from the periphery of said annular portion for contacting the lip of said container in a manner that an increase in container pressure will increase contact force between said sealing fin and said lip; and retention means retaining said insert attached to said cap while allowing relative rotation between said insert and said cap.

2. The closure according to claim 1 wherein said insert is made with a material providing a gaseous barrier.

3. The closure according to claim 2 wherein said insert is made with PET.

4. The closure according to claim 1 wherein a tamper indicating band depends from said cap skirt.

5. The closure according to claim 1 wherein said retention means includes an inner skirt member extending downwardly from said cap top and diverging outwardly and an inner skirt socket extending upwardly from said liner converging inwardly for snap retention on said inner skirt member.

* * * * *